United States Patent [19]

Shimoma et al.

[11] Patent Number: 4,820,958

[45] **Date of Patent: * Apr. 11, 1989**

[54] COLOR CATHODE RAY TUBE DEVICE

[75] Inventors: Taketoshi Shimoma, Isezaki; Kumio Fukuda, Hyogo, both of Japan

[73] Assignee: Kabushiki Kaisha Toshiba, Kawasaki, Japan

[ * ] Notice: The portion of the term of this patent subsequent to Aug. 25, 2004 has been disclaimed.

[21] Appl. No.: 865,352

[22] Filed: May 21, 1986

[30] Foreign Application Priority Data

May 21, 1985 [JP] Japan ..... 60-106957
Aug. 19, 1985 [JP] Japan ..... 60-180511

[51] Int. Cl.[4] ..... H01J 29/70; H01J 29/50

[52] U.S. Cl. ..... 315/368; 315/370; 313/412

[58] Field of Search ..... 315/368, 370, 371; 313/412

[56] References Cited

U.S. PATENT DOCUMENTS

| | | | |
|---|---|---|---|
| 3,440,482 | 4/1969 | Lister et al. | 315/370 |
| 3,735,193 | 5/1973 | Ikeuchi | 315/370 |
| 3,789,258 | 1/1974 | Barbin | 315/368 |
| 3,800,176 | 3/1974 | Gross et al. | 315/368 |
| 3,930,185 | 12/1975 | Barkow et al. | 315/370 |
| 3,975,766 | 8/1976 | Sano et al. | 315/368 |
| 3,984,723 | 10/1976 | Gross et al. | 313/412 |
| 4,689,525 | 8/1987 | Shimoma et al. | 315/370 |

FOREIGN PATENT DOCUMENTS

| | | |
|---|---|---|
| 0203765 | of 0000 | European Pat. Off. . |
| 498123 | of 0000 | Japan . |
| 574061 | of 0000 | Japan . |

OTHER PUBLICATIONS

20AX 110° Colour Television: A Brief Outline, M. Prescott, pp. 186–197, 1/75.

*Primary Examiner*—Theodore M. Blum
*Assistant Examiner*—David Cain
*Attorney, Agent, or Firm*—Oblon, Fisher, Spivak, McClelland & Maier

[57] ABSTRACT

Three electron beams are generated so that they are arranged in-line in a horizontal plane to impinge through a shadow mask on a phosphor screen consisting of red, green and blue phosphors. These beams are generated practically parallel. In the deflection device that deflects the electron beams, the horizontal deflection magnetic field is made uniform and the vertical deflection magnetic field is made barrel shaped. The half-width a of the magnetic flux distribution on the tube axis of the horizontal deflection magnetic field is set so that a/A=0.1 to 0.4, where A is the distance from the center of the magnetic flux density distribution to the phosphor screen surface. It is arranged that the picture signals modulating the respective beams are not mutually time-wise offset since the three electron beams are parallel. Thus little electron beam spot distortion is obtained over the whole picture screen.

4 Claims, 4 Drawing Sheets

SCREEN CENTER

SCREEN PERIPHERY

COLOR CATHODE RAY TUBE DEVICE

BACKGROUND OF THE INVENTION

This invention relates to a color cathode ray tube device with an in-line electron beam arrangement.

The envelope of a color cathode ray tube device consists of: a neck in which are installed three electron guns that generate three electron beams and are aligned in the horizontal direction; a face plate having a phosphor screen; and a funnel disposed between the neck and the face plate.

The three electron beams generated from the in-line type electron guns, mounted in a horizontally in-line arrangement, are directed onto the phosphor screen, which is formed coated with phosphor layers, causing the phosphor layers to emit light. In order to achieve good color reproduction with the light emitted from the phosphor layers, the electron beams must be made to impinge selectively on prescribed phosphor layers. This is achieved by arranging a shadow mask formed with a large number of apertures close to the face plate.

The in-line electron guns incorporate separate cathodes and are designed so as to generate three electron beams in a common horizontal plane and bring them to convergence in the vicinity of the face plate. Known methods of bringing the three electron beams to convergence include for example the technique disclosed in U.S. Pat. No. 2,957,106 (Moodey), in which the side beams in the electron beams emitted from the cathodes are bent from the start, and the technique disclosed in U.S. Pat. No. 3,772,554 (Hughes), in which the electron beams are converged by, of the apertures provided in the electron beam electrodes for passage of the three electron beams, displacing those apertures which are on both sides of part electrode slightly to the outside from the centre axes of the electron guns, thereby bending the electron beam by creating a potential gradient in the electric field generated at the displaced portions. Both these methods are widely used.

To make the phosphor screen of a color cathode ray tube display a TV picture, the electron beams must be scanned over the entire surface of the phosphor screen. This is done by mounting a deflection device outside the cone portion of the funnel. Essentially the deflection device comprises horizontal deflection coils for generating a horizontal deflection magnetic field that deflects the electron beam in the horizontal direction and vertical deflection coils for generating a vertical deflection magnetic field that deflects the electron beam in the vertical direction. In practical color cathode ray tubes when the electron beams are deflected by a uniform magnetic field, because of the leakage field that extends beyond the end surface of coils, convergence of the three electron beam spots on the face plate is lost. Various countermeasures have to be adopted to deal with this, so that the spots always converge over the whole surface of the screen. Such a system is termed a "convergence free system". In this system, convergence of the three electron beams over the entire phosphor screen is achieved by making the horizontal deflection magnetic field of pin-cushion form, and making the vertical deflection magnetic field of barrel form. If the vertical magnetic field is uniform, there is overconvergence which increases in degree from the center of the screen towards the top and bottom ends, but with a barreltype magnetic field, convergence can be achieved over the entire screen. As a result, with such a system, a parabolic current generating circuit for convergence compensation and a convergence yoke for generating a convergence compensating magnetic field can be dispensed with, conferring many advantages such as cost saving and productivity gain.

As explained above, the quality of color cathode ray tubes has been improved by many technical developments. However, as large tubes have become common, fresh problems have come to the fore.

One of these problems concerns the shape of the beam spot where the electron beams are brought to convergence on the face plate after being emitted from the electron guns. As shown in FIG. 4(*a*), in the middle of the screen, where the beams are not subjected to any deflection, the spot $S_{4a}$ consists simply of a round core Sc, i.e. a region of high electron density. However, as shown in FIG. 4(*b*), due to non-uniformity of the deflection magnetic field, in the peripheral regions of the screen, where the spot $S_{4b}$ is subject to deflection, the spot presents a flattened core $S_c$ with vertically extending flares $S_f$(i.e. portions of lower electron density). As a result, the electron beam size increases at the edges of the screen, producing a deterioration in focussing property and resolution.

Specifically, if we take the horizontal dimension of the core for the case of a 20 inch 90 degree deflection tube as $C_H$ and its vertical dimension as $C_V$, in the middle of the screen $C_H=C_V=1.0$mm, but at the extreme end region of the horizontal deflection the core has a very flattened shape with $C_H=20$mm and $C_V=0.3$mm. Also, the dimension $F_V$ from the top to the bottom of the flares is 1.5mm. These values are for the case where the electron beam is deflected in the horizontal direction only. In the corners of the screen, where a vertical deflection is added to the horizontal deflection, the dimensions are even more distorted.

SUMMARY OF THE INVENTION

It is an object of this invention to provide a bright color cathode ray tube device which overcomes the abovementioned drawbacks, wherein high resolution is obtained over the whole area of the screen with little distortion of the electron beam spot at the peripheral parts of the screen.

According to this invention, a color cathode ray tube is provided with:

an envelope comprising a face plate, a funnel sealed onto the face plate and a neck connected to the funnel;

a phosphor screen on the inside of the face plate and that emits light in the three colors red, green, and blue in-line electron guns arranged in the neck to emit towards the phosphor screen three electron beams that are inline in the horizontal direction of the phosphor screen;

a shadow mask arranged in the vicinity of the phosphor screen and having a large number of apertures to make the electron beams selectively impinge on the screen; and a deflection device attached outside the funnel, comprising a horizontal deflection magnetic field generating device that generates a horizontal deflection magnetic field that deflects the electron beams that are emitted from the electron guns in the horizontal direction and a vertical deflection magnetic field generating device that generates a vertical deflection magnetic field that deflects the beams in the vertical direction.

The electron beams generated from the electron guns are practically parallel. The horizontal defection magnetic field forms a practically uniform magnetic field distribution and the vertical deflection magnetic field forms a barrel type magnetic field distribution. The halfwidth a of the magnetic flux density distribution of the horizontal deflection magnetic field on the tube axis is within the range 0.1 to 0.4 times the distance A from the center of this flux density distribution to the phosphor screen. A better effect is obtained in the range a is 0.2 to 0.3 times the value of A. The best characteristic is shown when a is about 0.25 times the value of A.

By having respective time delays in the times at which these three picture signals for the colors red, green and blue to the electron guns are controlled, the picture information of the three electron beams are made to converge on or near the face plate.

PREFERRED EMBODIMENT OF THE INVENTION

This invention will now be described with reference to the results of experiments carried out by the inventors with a color cathode ray tube.

Figure 2A:
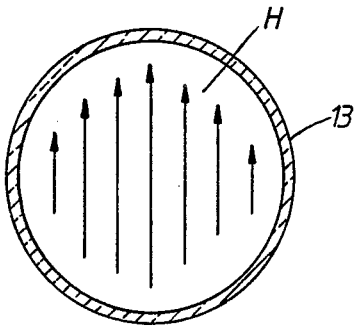
FIG. 2 (*a*) and (*b*) are cross-sectional views shown sectioned along the line A—A of FIG. 1, FIG. 2(*a*) being given in explanation of the horizontal deflection magnetic field and FIG. 2(*b*) being given in explanation of the vertical deflection magnetic field.
Figure 2B:
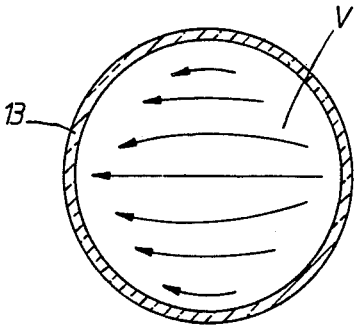
Figure 5A:
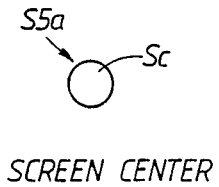
FIG. 5, FIG. 7 and FIG. 8 are views given in explanation of the shape of the electron beam spot according to this invention.
Figure 5B:
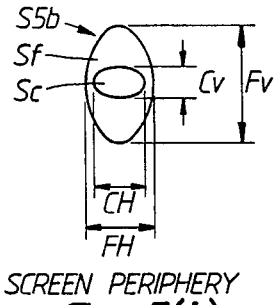

Noting that one of the factors producing distortion of the electron beam spot at the periphery of the screen is the pin-cushion shape of the horizontal deflection magnetic field, the inventors tried making the horizontal deflection magnetic field uniform, remaining the the vertical deflection magnetic field barrel shaped. FIG. 5 shows the electron beam spot shapes $S_{5a}$ and $S_{5b}$ at the center of the screen and the at periphery of the screen for a uniform horizontal deflection magnetic field H as shown in FIG. 2(*a*) in 20 inch 90 deflection tube, $C_H$=1.5mm, and $C_V$=0.6mm, and it can be seen that the shape of the region of high electron density i.e. the core $S_c$ is much improved.

However, the shape of this electron beam spot is still not fully satisfactory.

By further experiments, it is found that if a prescribed relationship between the magnetic flux density distribution of the deflection magnetic field and the size of the color cathode ray tube is established, the shape of the flares $S_f$ around the core $S_c$ can be further improved.

Figure 3:
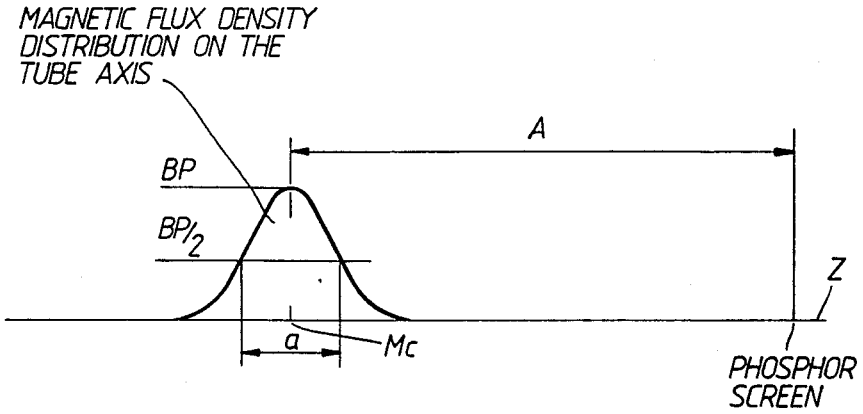
FIG. 3 is a view given in explanation of the magnetic flux density distribution on the tube axis Z of the horizontal deflection magnetic field according to this invention.
Figure 4A:
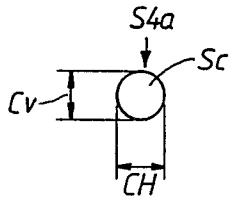
FIG.4(a) PRIOR ART
FIG. 4 is a view given in explanation of the shape of the electron beam spot in the conventional device.
Figure 4B:
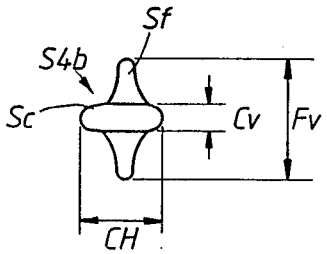
FIG 4(b) PRIOR ART

FIG. 3 shows the relationship of the magnetic flux density distribution of a uniform horizontal deflection magnetic field on the tube axis Z with the distance from the center of this distribution to the phosphor screen.

Figure 6:
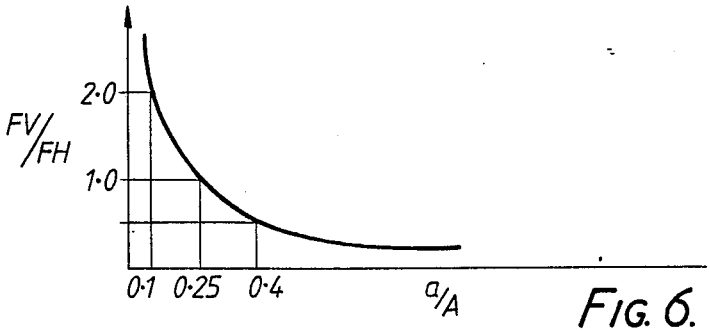
FIG. 6 is a graph given in explanation of the relationship between the deflection magnetic field according to this invention and the shape of the electron beam spot.

The center of the flux density distribution is defined as the position showing the maximum value $B_p$ of the flux density distribution. The magnetic path length is defined a as the length determined by the width between the points where the value is half the maximum value $B_p$, and A as the distance from the center $M_c$ of the flux density distribution to the face plate. The spot $S_{5a}$ at the center of the screen is shown in FIG. 5(*a*), and is core $S_c$. As shown in FIG. 5(*b*), when spot $S_{5b}$ having flares $S_f$ is formed at the screen periphery, the dimension of the horizontal direction of the flares is $F_H$ and the dimension of the vertical direction is $F_V$. It was found that in this case the relationship shown in FIG. 6 exists between a/A and $F_V/F_H$. Having ascertained that it is necessary that the value of the $F_V/F_H$ when evaluated from the practical point of view should be at least 0.5 and not more than 2.0, when this is substituted in FIG. 6, the practical range of a/A is from 0.1 to 0.4. Preferably the range of a/A is 0.2 to 0.3. The most ideal condition is obtained when a/A $\simeq$0.25, when the flares $S_f$ is circular and its minimun size.

Figure 7A:
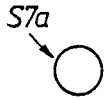
Figure 7B:
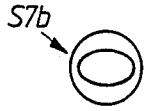
Figure 8A:
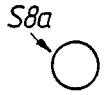
Figure 8B:
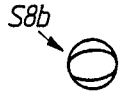

FIG. 7 shows respectively the shapes $S_{7a}$ and $S_{7b}$ of the electron beam spot at the center and at the periphery of the screen when a/A $\simeq$0.25. To further improve the electron beam spot shape $S_{7b}$ in FIG. 7 at the peripheral regions of the screen, the focal point distances of the electron lenses of the electron guns are adjusted at the peripheral regions of the screen. Spot $S_{8b}$ in FIG. 8(*b*) shows an example of the improvement which this makes possible. As shown by $S_{8a}$ the shape of the spot at the center of the screen is unchanged.

The electron beam spot shape is further improved by the above construction. Convergence of the three electron beams over the entire surface of the face plate is further improved in the above construction of this invention by making the three electron beams generated from the electron guns practically parallel and providing a time delay in the times with which the signals that are applied to the three electron guns are mutually controlled.

The method by which this is done will now be described. When the various color picture signals are input at the same time to the three electron guns the electron beam spots on the face plate are separated from each other by a constant amount Δ. However, in this method, the time at which the signal is applied to the second electron gun is delayed by a time $\tau$ with respect to the time at which the signal is applied to the first electron gun, and time at which the signal is applied tot he third electron gun is delayed by a time $\tau$ with respect to the time at which the signal is applied to the second electron gun. If we let the horizontal width of the screen be H, the horizontal deflection frequency be $f_H$, and the constant determined by the overscan be C, by making the delay time$=C\Delta/f_H H$, electron beam spot convergence can be achieved over the whole area of the screen.

The amount of offset Δ of the spots of the three electrons beams is one factor in this invention, so it is preferable to keep this Δ constant over the entire screen surface. To this end, the vertical deflection magnetic field must be made barrel shaped.

The effect that the barrel-shaped magnetic field has on the offset amount Δ is given by:

$$\int H_z Y(Z-Z_s)\,dZ \qquad (1)$$

In this equation, $H_z$ is a coefficient indicating the non-uniformity of the magnetic field and is defined by $H_z=(^2H/y^2)$. Y is the amount of deflection of the beam from the tube axis of the color cathode ray tube, and increases with increased proximity to the face plate. $Z_s$ represents the distance from the face plate to the starting point of deflection. Thus the effect of the barrel-shaped magnetic field on the amount of offset Δ is greater, the larger the value of Y i.e. with increased proximity of the deflecting magnetic field to the face plate.

The extent of the flares is proportional to $$\int H_z Y(Z-Zs)^2 dZ \quad (2)$$

In this formula (2) the effect of the term ($Z$-$Z_s$) is augmented in comparison with formula (1). This shows that flares are generated uniformly comparatively irrespective of position in the magnetic field. Consequently, to keep the amount of offset Δ constant by a magnetic field with minimum non-uniformity while suppressing the production of flares as far as possible, it is important to form the barrel shaped magnetic field as near to the face plate as possible.

When applying this invention to large color cathode ray tubes or tubes with a large angle of deflection such as 110 degrees, the mutual positional relationship between the horizontal deflection magnetic field and the vertical deflection magnetic field should be optimized. By this means the residual convergence error can be reduced over the entire surface of the screen than the center of the vertical magnetic field.

Figure 1:
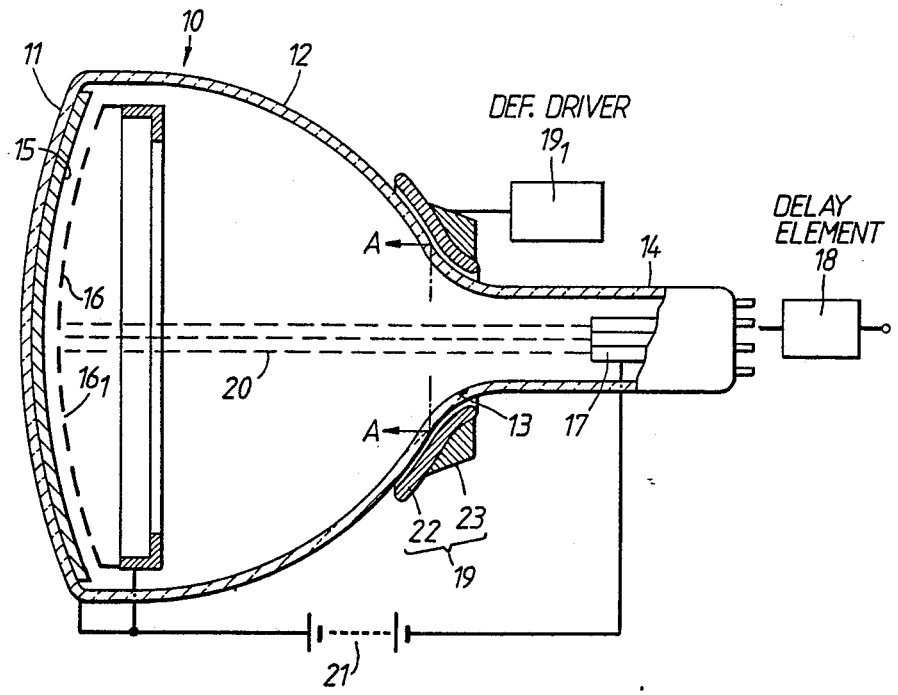
FIG. 1 is a cross-sectional view of an embodiment of this invention.

FIG. 1 shows a 20 inch color cathode ray tube with 90 degree deflection according to an embodiment of this invention.

A glass envelope 10 is provided with a face plate 11, a funnel 12 integrally sealed to this face plate11, and a neck 14 connected to the funnel.

The inside face of face plate 11 is formed with a phosphor screen 15 for picture display. This phosphor screen is made up of a regular arrangement of phosphor dots or phosphor stripes that emit red, green and blue light. A shadow mask 16 is arranged facing and adjacent to screen 15. Shadow mask 16 normally comprises a thin iron plate of dome shape matching the internal shape of face plate 11, whose portion facing screen 15 is formed with a large number of apertures 16, so arranged that three electron beams 20 impinge correctly on the phosphors of the corresponding color.

Electron guns 17 that generate the three electron beams used for the three colors red, green, and blue are sealed into neck 14. The electron beams 20 are disposed in-line in the horizontal direction, i.e. the electron beams lie in the same horizontal plane. The arrangement is such that the electron beams are emitted parallel to each other with a mutual separation of about 6.6mm. The electron guns are integrated as a single unit comprising electron emitting cathodes and common electrodes of control, screen, focus and convergence cup electrodes. These are supplied with respective prescribed voltages. The potential of the high voltage electrodes as the convergence cup is usually ultra high potential (25kV). The phosphor screen and shadow mask are maintained at an equivalent potential of 25 kV as same as the high voltage electrode by a power source 21.

A deflection device 19 is mounted in the vicinity of the region (usually called the "cone" 13) where neck 14 joins funnel 12. The picture signal is input between the cathodes and control electrodes corresponding to the respective electron beams. In scanning, if the "blue" beam is the leading beam, passing over the screen first, the blue picture signal is input first across the electrodes. The picture signals of the "green" and "red" beams, which follow the "blue" beam with a certain offset, are then input, as described, with respective time delays $\tau$ and $2\tau$. These delays are produced by delay element 18.

Deflection device 19 comprises a saddle shaped horizontal deflection coil 22 that generates a uniform magnetic field H as shown n FIG. 2(*a*), which constitutes the magnetic field that deflects electron beams 20 in the horizontal direction, and a toroidal vertical deflection coil 23 that generates a barrel shaped magnetic field V as shown in FIG. 2(*b*), which constitutes the field that deflects the beam in the vertical direction. The deflection coils are designed such that the half-width a of the flux density distribution on the tube axis of the horizontal deflection magnetic field and the vertical deflection magnetic field is 0.25 times the distance A from the center of the flux density distribution to the phosphor screen. Deflection device 19 is driven by deflection drive $19_1$.

For a 20 inch 90 degree deflection tube, the horizontal width of the picture (phosphor screen) is about 400mm. If we assume that the horizontal deflection frequency is 15.75 kHz, the amount of mutual offset Δ of the electron beam spots on the screen is 6.6mm, and the constant C is 0.75, the time delay of input of the picture signals for the various colors to the respective electron guns is about 0.8 microsecond.

The device produces pictures that the distortion of beam spot core and flare is minimized at both of the center and corner of the screen, bright and whth high resolution at the whole screen.

In another embodiment of this invention, 26 inch 110 degree deflection tubes were used, while the other conditions were the same as in the preceding embodiment. When an evaluation was made of such color cathode ray tubes with a/A equal to 0.1 and a/A equal to 0.4 respectively, it was found that in both cases better performance was obtained than with a conventional system, in which the horizontal magnetic field is of the pin cushion type. When a/A was set to 0.2 to 0.3, performance was even further improved.

Figure 9:
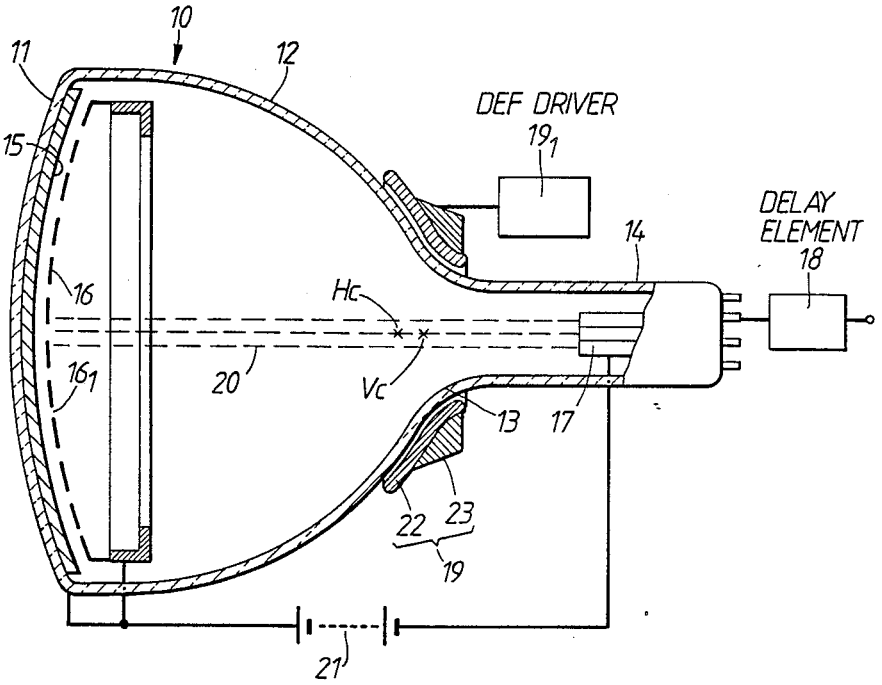
FIG. 9 is a cross-sectional view of another embodiment of the invention.

Although in the 20 inch 90 degree deflection tube of the above embodiment the centers of the horizontal and vertical deflection magnetic fields were set at about 290mm from the phosphor screen, in another embodiment, as shown in FIG. 9, the position of the center $H_c$ of the horizontal deflection magnetic field is set at about 285 to 280mm from the phosphor screen, and the position of the center $V_c$ of the vertical deflection magnetic field is set at about 295 to 300mm from the phosphor screen. Members which are the same as in FIG. 1 are given the same reference numerals.

In other words, the center $H_c$ of the horizontal deflection magnetic field is advanced from the center $V_c$ of the vertical deflection magnetic field towards the phosphor screen 15 by an amount in the range 10 to 20mm. It was found that this resulted in a further substantial improvement in the convergence accuracy attainable with three electron beams.

This invention has been described above under the assumption that, in the undeflected state, the electron beams are practically parallel. This of course includes the case where they are geometrically parallel. However, without departing from the essence of this condition, the invention can of course also be applied to a color cathode ray tube wherein color offset correction is performed by applying constant delay times to the respective color signals, although, under conditions of zero deflection, the three electron beams are actually out of convergence i.e. are substantially non coincident.

Usually a static convergence device is mounted on the electron gun side of the deflection coils and its hexapolar magnetic flux component leaks into the deflection magnetic field. To cancel this leakage component, the deflection field with hexapolar component compensation magnetic field as a result is of course also included in the uniform deflection magnetic field.

We claim:

1. In a color cathode ray tube device comprising:

an envelope including a face plate, a funnel sealed to said face plate and a neck connected to said funnel;

a phosphor screen formed on the inside of said face plate for emitting light in the three colors red, green, and blue;

in-line electron gun means in said neck for generating substantially parallel three electron beams in a direction toward said phosphor screen;

a shadow mask arranged in the vicinity of said phosphor screen, including a large number of apertures for selective impingement of said electron beams on said phosphor screen; and deflection means for deflecting said electron beams from a substantially parallel orientation and for maintaining a parallel relation among said electron beams, the improvement comprising:

said deflection means including, means for generating a horizontal deflection magnetic field having a substantially uniform magnetic field distribution, means for generating a vertical deflection magnetic field having a barrel shaped magnetic field distribution, and said means for generating a horizontal deflection magnetic field comprising a deflection coil dimensioned so that a half-width of the magnetic flux density distribution of said horizontal deflection magnetic field, measured on the envelope axis, is in the range of about 0.1 to about 0.4 times the distance from the center of said flux density distribution to said phosphor screen; and a time delay means for applying a time delay to the times at which the picture signals of the respective colors red, green and blue inputted to said electron gun means are controlled.

2. The color cathode ray tube device according to claim 1 wherein the half-width a of the magnetic flux density distribution of the tube device axis of said horizontal deflection magnetic field is within the range 0.2 to 0.3 times the distance A from the center of said flux density distribution.

3. The color cathode ray tube device according to claim 1 wherein said vertical deflection magnetic field is a barrel shaped magnetic field distribution at least on the screen side.

4. The color cathode ray tube device according to claim 1 wherein the center of the flux density distribution of said horizontal deflection magnetic field is arranged closer to said screen than is the center of the flux density distribution of said vertical deflection magnetic field.

* * * * *